United States Patent [19]

Luzzani et al.

[11] 4,077,335

[45] Mar. 7, 1978

[54] EXTENSIBLE TABLE

[76] Inventors: Umberto Luzzani, V. Febo Borromeo 5, Senago (Milan); Giuseppe Riva, V. Monte Nevoso 3, Paderno Dugnano (Milan), both of Italy

[21] Appl. No.: 748,595

[22] Filed: Dec. 8, 1976

[51] Int. Cl.[2] ..... A47B 1/05

[52] U.S. Cl. ..... 108/75; 108/111

[58] Field of Search ..... 108/75, 73, 76, 111, 108/156, 153; 5/21

[56] References Cited

U.S. PATENT DOCUMENTS

| | | | |
|---|---|---|---|
| 1,182,731 | 5/1916 | Anthony | 5/21 |
| 1,532,715 | 4/1925 | Petrarca | 108/75 |
| 2,102,449 | 12/1937 | Zimmerman | 108/75 X |
| 2,874,708 | 2/1959 | Daus | 108/153 X |
| 3,747,965 | 7/1973 | Wing | 108/111 X |
| 3,835,354 | 9/1974 | Torres-Pena | 108/111 |

FOREIGN PATENT DOCUMENTS

| | | | |
|---|---|---|---|
| 1,227,348 | 3/1960 | France | 108/73 |
| 866,225 | 4/1961 | United Kingdom | 108/75 |

*Primary Examiner*—Francis K. Zugel

[57] ABSTRACT

An extensible table has a rectangular frame with pairs of longitudinal beams and cross beams, a leg at each corner, and two draw-out plates which can be selectively stacked, and aligned in co-planar condition. The improvement is that each leg has a top recess in which is engaged a male portion of a shoulder element including an upper L-shaped portion defining a cavity to receive the cross beams. Roller means are on one arm of the L-shaped portion to carry the draw-out plates. Each longitudinal beam has on an inner face a mirror-image groove formation in which are received lateral rollers on the draw-out plates.

3 Claims, 6 Drawing Figures

FIG. 1
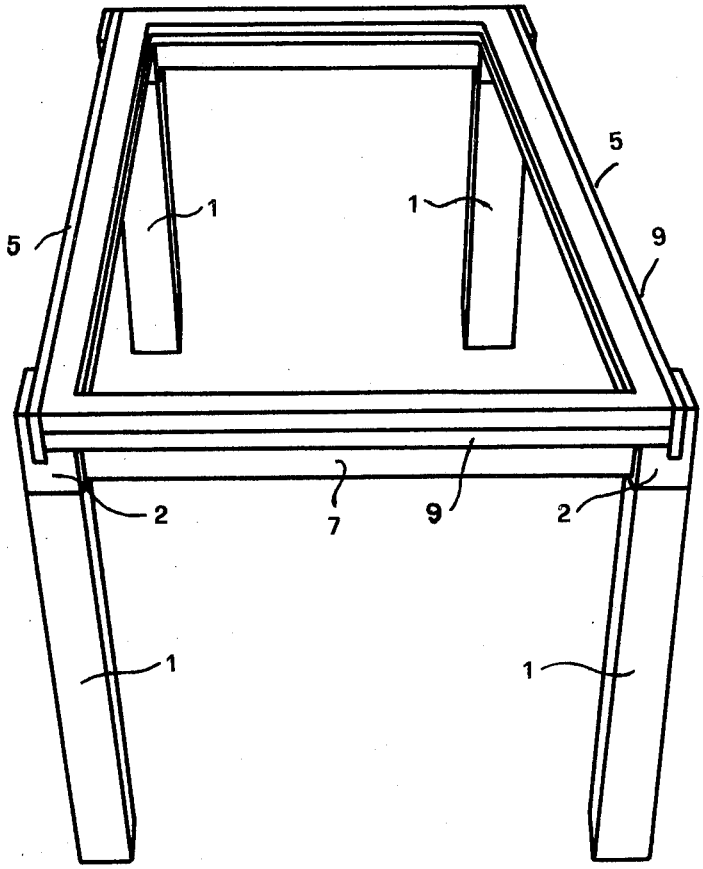
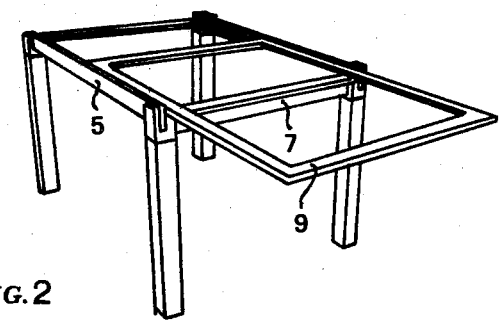
FIG. 2
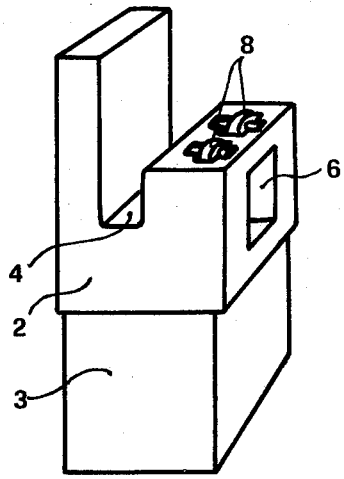
FIG. 3

EXTENSIBLE TABLE

This invention relates to an extensible table, consisting preferably of metal, and more particularly to a table the upper surface may be extended by the doubling of the available surface by the ejection of two extensible plates constituting it.

As is well known there exist at present different types of table which by extending ensure an increase of the area of the upper support surface.

The aforesaid tables have, however, the inconvenience that by the extension of the spread-out plate it is possible to obtain an increase of the surface of the support plate equivalent to a portion of the already available surface.

Furthermore, the traditional devices are of a rather complicated nature and make the tables heavy, thereby making the manual ejection of such spread-out plates uncomfortable and fatiguing.

There is further the fact that the traditional extension panel, consisting of a generally removable member, often does not have perfect coplanarity relative to the plate forming the base surface.

The table according to the present invention overcomes the above-mentioned inconveniences. It affords in fact besides the advantage of ensuring the doubling of the rectangular surface, also the feature of carrying out the lengthening and shortening operations in a particularly simple and easy manner. Such particular advantages are obtained according to the present invention by causing the draw-out plates to slide over support rollers.

These and further characteristic features of a functional and constructional nature of the extensible table of this invention may best be understood from the following detailed description, taken in conjunction with the accompanying drawings, in which:

FIG. 1 represents in a perspective view the table of this invention with the upper frame without the plate, which may consist of any material whatsoever;

FIG. 2 shows in a perspective view the table given in FIG. 1, in which one of the two spread-out plates is arranged in the position for doubling the supporting rectangular surface;

FIG. 3 represents in a perspective view a portion of the angular shoulder of the table in the preceding figures;

Figure 4:
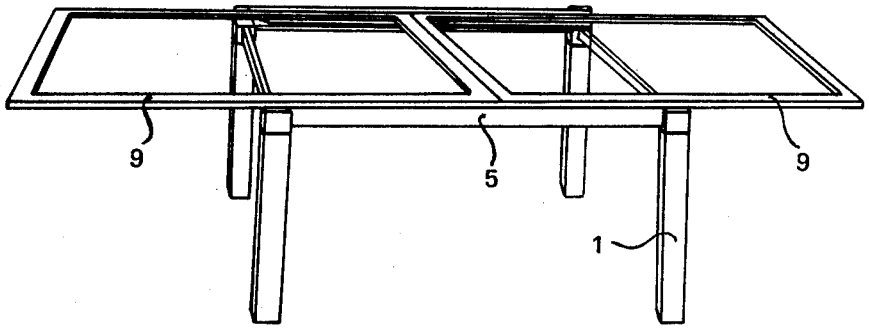
FIG. 4 shows in a perspective view the table of this invention the spread-out plates of which appear in the most extended position so as to obtain the doubling of the surface.
Figure 5:
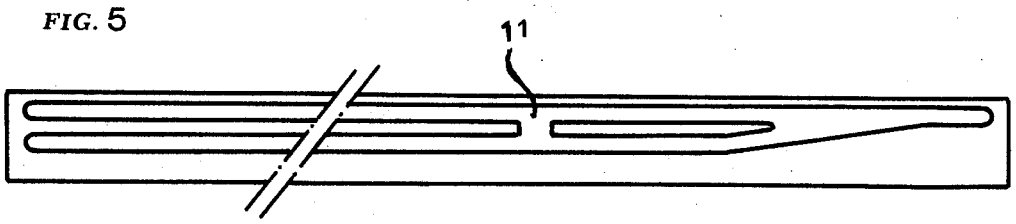
FIG. 5 represents the partial construction diagram of the grooves formed on the inner sides of the longitudinal beams and constituting means for support of the plates during their ejection from the table frame or the insertion into the body thereof.
Figure 6:
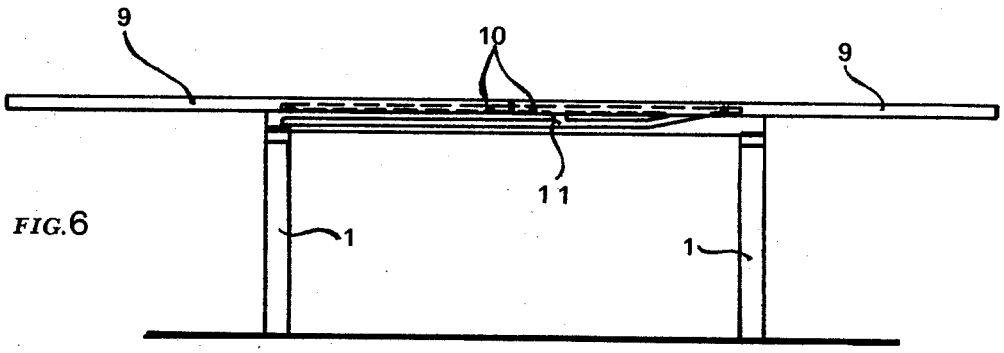
FIG. 6 shows in a schematical form the cross section of the table in FIG. 4, in which there are shown the grooves formed on the inner side of the beams and in which the plates move on roller pairs.

The extensible table of this invention, provided with two spread-out plates, consists of a frame, including four vertical columns 1 or legs, each of them carrying a shoulder element 2. The said element 2 is formed by a male portion 3 which fits into the top opening of each column 1 and an upper L-shaped body, provided with a cavity 4 for the fastening of a longitudinal beam or lath 5 and a cavity 6 for the fastening of a cross beam 7. In the upper surface of the vertical arm of one upper body there is embedded a pair of rollers 8, which permit the sliding and the support of the spread-out or draw-out plates 9.

The longitudinal beams 5, which together with the cross beams 7, connect pairwise the shoulder elements have at the inner side mirror image symmetrical developments of grooves 11.

The said grooves 11 sustain the spread-out plates 9 in the final closing and maximum useful extension positions and constitute a sliding seat for rollers 10 extending from the side edges of the plates, during the insertion and draw-out operations of the plates themselves.

In the maximum extension position the plates lie perfectly coplanar, whereas in the closing position they are perfectly overlapped with each other.

From the foregoing and from perusal of the various figures on the accompanying drawings one may easily see the great functional character and the practical application, characterizing the extensible table of this invention.

Several changes and modification may be introduced in the practical accomplishment of this invention, without exceeding the scope of the appended claims.

We claim:

1. In an extensible table, of that kind which includes a rectangular frame constituted by two opposed spaced parallel longitudinal beams and two opposed spaced parallel cross beams, four legs arranged one at each corner of the frame, and two draw-out plates slidable into a first stacked position and a second position in which they are extended end-to-end, the improvement which comprises:

i. each said leg having a recess opening at its top end ii. four shoulder elements each having a male portion engaged into the recess of a respective leg, and an upper L-shaped portion including two spaced vertical arms defining between them a cavity receiving an end of a longitudinal beam, and a recess receiving an end of a cross beam, iii. roller means protruding from the upper end of a vertical arm of the L-shaped portion to carry the draw-out plates, iv. the longitudinal beams each having on an inner face opposed to an inner face of the other longitudinal beam a respective mirror-image groove formation, v. lateral roller means mounted on said draw-out plates and engaged in said groove formations.

2. An extensible table, as claimed in claim 1, wherein said groove formations each include an upper linear groove to receive the lateral roller means of both said draw-out plates positioned end-to-end in co-planar relationship, a lower linear groove to receive the lateral roller means of a lower one of said draw-out plates when said draw-out plates are stacked, and two further grooves interconnecting said upper and lower grooves for passage of the lateral roller means between said upper and lower grooves.

3. An extensible table, as claimed in claim 1, wherein said draw-out plates are of the same shape and dimensions.

* * * * *